US011851960B2

(12) United States Patent
Tough et al.

(10) Patent No.: US 11,851,960 B2
(45) Date of Patent: Dec. 26, 2023

(54) METHOD FOR ISOLATION OF BOREHOLE PRESSURE WHILE PERFORMING A BOREHOLE OPERATION IN A PRESSURE ISOLATED BOREHOLE ZONE

(71) Applicant: DISRUPTIVE DOWNHOLE TECHNOLOGIES, LLC, Houston, TX (US)

(72) Inventors: John Murray Tough, Humble, TX (US); Stephen L. Crow, Humble, TX (US); Geoffrey Andrew Patton, Houston, TX (US)

(73) Assignee: DISRUPTIVE DOWNHOLE TECHNOLOGIES, LLC, Houston, TX (US)

( * ) Notice: Subject to any disclaimer, the term of this patent is extended or adjusted under 35 U.S.C. 154(b) by 0 days.

(21) Appl. No.: 17/740,203

(22) Filed: May 9, 2022

(65) Prior Publication Data

US 2023/0358110 A1 Nov. 9, 2023

(51) Int. Cl.

| | |
|---|---|
| ***E21B 33/124*** | (2006.01) |
| ***E21B 23/02*** | (2006.01) |
| ***E21B 43/12*** | (2006.01) |
| ***E21B 33/134*** | (2006.01) |

(52) U.S. Cl.

CPC ..... *E21B 23/02* (2013.01); *E21B 33/134* (2013.01); *E21B 43/128* (2013.01)

(58) Field of Classification Search

CPC .... E21B 33/124; E21B 43/128; E21B 34/142; E21B 33/12; E21B 33/128; E21B 33/134; E21B 34/14; E21B 41/0035

See application file for complete search history.

(56) References Cited

U.S. PATENT DOCUMENTS 2,320,670 A * 6/1943 Scaramucci ..... E21B 17/14 166/328
2,896,724 A * 7/1959 Baker ..... E21B 33/1216 277/338
3,213,940 A * 10/1965 Wood ..... E21B 33/16 166/291
3,584,645 A * 6/1971 Radig ..... E21B 34/08 137/454.2
3,850,194 A * 11/1974 Brown ..... E21B 21/10 137/496
4,171,019 A * 10/1979 Cole ..... E21B 41/0014 166/341

(Continued)

*Primary Examiner* — Robert E Fuller
*Assistant Examiner* — Neel Girish Patel
(74) *Attorney, Agent, or Firm* — Crowe & Dunlevy, P.C.

(57) ABSTRACT

An adaptive seat is run in with an isolating object to beyond a landing location for the adaptive seat. The adaptive seat is released to expand and engage the surrounding tubular. Pressure from below acts on the object and propels the object against the adaptive seat. The object and the adaptive seat move in the tubular to a nearby landing location such as a groove or recess in a sub that is part of the string or another location such as a tubular joint where the adaptive seat finds support. An upper portion of the borehole is isolated for a time from formation pressure to allow running in an ESP from the surface. The object is removed by degradation or from being structurally undermined and the ESP is operated to produce the formation. One or more removable barriers are contemplated.

20 Claims, 1 Drawing Sheet

(56) References Cited

U.S. PATENT DOCUMENTS

| | | | | |
|---|---|---|---|---|
| 5,704,426 | A * | 1/1998 | Rytlewski | E21B 43/14 175/4.52 |
| 6,328,111 | B1 * | 12/2001 | Bearden | E21B 23/02 166/381 |
| 8,459,362 | B2 * | 6/2013 | Ceccarelli | E21B 23/02 166/107 |
| 8,505,621 | B2 | 8/2013 | Telfer et al. | |
| 8,813,849 | B1 * | 8/2014 | Davis | E21B 34/12 166/329 |
| 10,072,486 | B2 | 9/2018 | Bennett et al. | |
| 10,273,769 | B2 | 4/2019 | Crow et al. | |
| 10,287,835 | B2 | 5/2019 | Crow et al. | |
| 10,738,563 | B2 | 8/2020 | Crow et al. | |
| 11,111,747 | B2 | 9/2021 | Crow | |
| 2002/0007949 | A1 * | 1/2002 | Tolman | E21B 33/138 166/305.1 |
| 2012/0012771 | A1 * | 1/2012 | Korkmaz | F16K 15/044 251/315.07 |
| 2013/0037273 | A1 * | 2/2013 | Themig | E21B 34/14 166/185 |
| 2013/0153220 | A1 * | 6/2013 | Carter | E21B 34/14 166/135 |
| 2017/0175487 | A1 * | 6/2017 | Marcin | E21B 34/14 |
| 2017/0321507 | A1 * | 11/2017 | Crow | E21B 23/02 |
| 2017/0321513 | A1 * | 11/2017 | Crow | E21B 33/1208 |
| 2017/0321514 | A1 * | 11/2017 | Crow | E21B 23/06 |
| 2017/0362913 | A1 * | 12/2017 | Randle | E21B 33/1208 |
| 2019/0234174 | A1 * | 8/2019 | Crow | E21B 23/02 |
| 2020/0173249 | A1 * | 6/2020 | Fairweather | E21B 33/13 |
| 2020/0347694 | A1 * | 11/2020 | Power | E21B 33/128 |

* cited by examiner

METHOD FOR ISOLATION OF BOREHOLE PRESSURE WHILE PERFORMING A BOREHOLE OPERATION IN A PRESSURE ISOLATED BOREHOLE ZONE

FIELD OF THE INVENTION

The field of the invention is borehole pressure isolation and more particularly isolation of a treated section of the borehole so that equipment can be introduced or a procedure performed from a surface location without exposure to isolated formation pressure. A removable barrier allows subsequent production from the formation without milling.

BACKGROUND OF THE INVENTION

Adaptive supports and devices to deliver them to a groove or a recess in a tubular or in a similar support location between tubulars have been described in U.S. Pat. Nos. 10,287,835 and 10,273,769. Adaptive supports that permit flowback to a surface location or that use bottom hole pressure to position an adaptive support while permitting a ball to push through the adaptive support once seated in a groove are described in U.S. Pat. No. 10,738,563. Preformed grooves in tubulars for whipstock locating when milling a window are illustrated in U.S. Pat. No. 8,505,621.

Electric submersible pumps (ESP) are used to boost pressure to produce a formation and are introduced into the borehole under conditions that isolate the upper segment of the borehole from formation pressure. One way this is done is with kill fluids as described is U.S. Ser. No. 10/072,486. Another way is to use a combination of a formation isolation valve (FIV) to introduce the ESP with borehole pressures below being isolated. The ESP is tagged into a polished bore receptacle (PBR). Mechanisms are provided to operate the FIV to the closed position and to subsequently open the FIV after the ESP is sealingly positioned in the PBR. Such a system is described in U.S. Pat. No. 8,459,362. Such procedures that are described above are expensive from a hardware standpoint and provide some operational uncertainties. Killing the well to introduce the ESP also adversely affects future production from the formation.

What is needed and is addressed by the present invention is equipment and a method to rapidly deploy a barrier to formation pressure after treatment of the formation below. A removable barrier is deployed for such pressure isolation with removal being triggered at a time after the introduction and optionally securing the ESP while formation pressures are isolated. One or more such barriers are contemplated with the first being used to determine effective isolation and another that can be optionally used if additional barriers are desired for any reason. Well fluids or introduced fluids can be used to remove the barrier without milling. An adaptive seat can be advanced into a recess or groove located in a tubular sub or connection between tubulars with a ball or other object such that downhole pressure can propel the object against the adaptive seat and translate the adaptive seat to an anchor location. The extension of the adaptive seat after release into the tubular flow path is minimal so that subsequent milling is not contemplated and production flow is minimally impacted. The object is undermined and passes through the adaptive seat to allow production to commence. The ESP is deployed above the adaptive seat, preferably on coiled tubing. These and other aspects of the method will be explained in greater detail below with the understanding by those skilled in the art that the appended claims define the full scope of the invention.

SUMMARY OF THE INVENTION

An adaptive seat is run in with an isolating object to beyond a landing location for the adaptive seat. The adaptive seat is released to expand and engage the surrounding tubular. Pressure from below acts on the object and propels the object against the adaptive seat. The object and the adaptive seat move in the tubular in tandem to a nearby landing location such as a groove or recess in a sub that is part of the string or another location such as a tubular joint where the adaptive seat finds support. An upper portion of the borehole is isolated for a time from formation pressure to allow running in an ESP from the surface. The object is removed by degradation or from being structurally undermined and the ESP is operated to produce the formation. One or more removable barriers are contemplated.

DETAILED DESCRIPTION OF THE PREFERRED EMBODIMENT

Figures 1, 2, 3, 4, 4A, 5, 6:
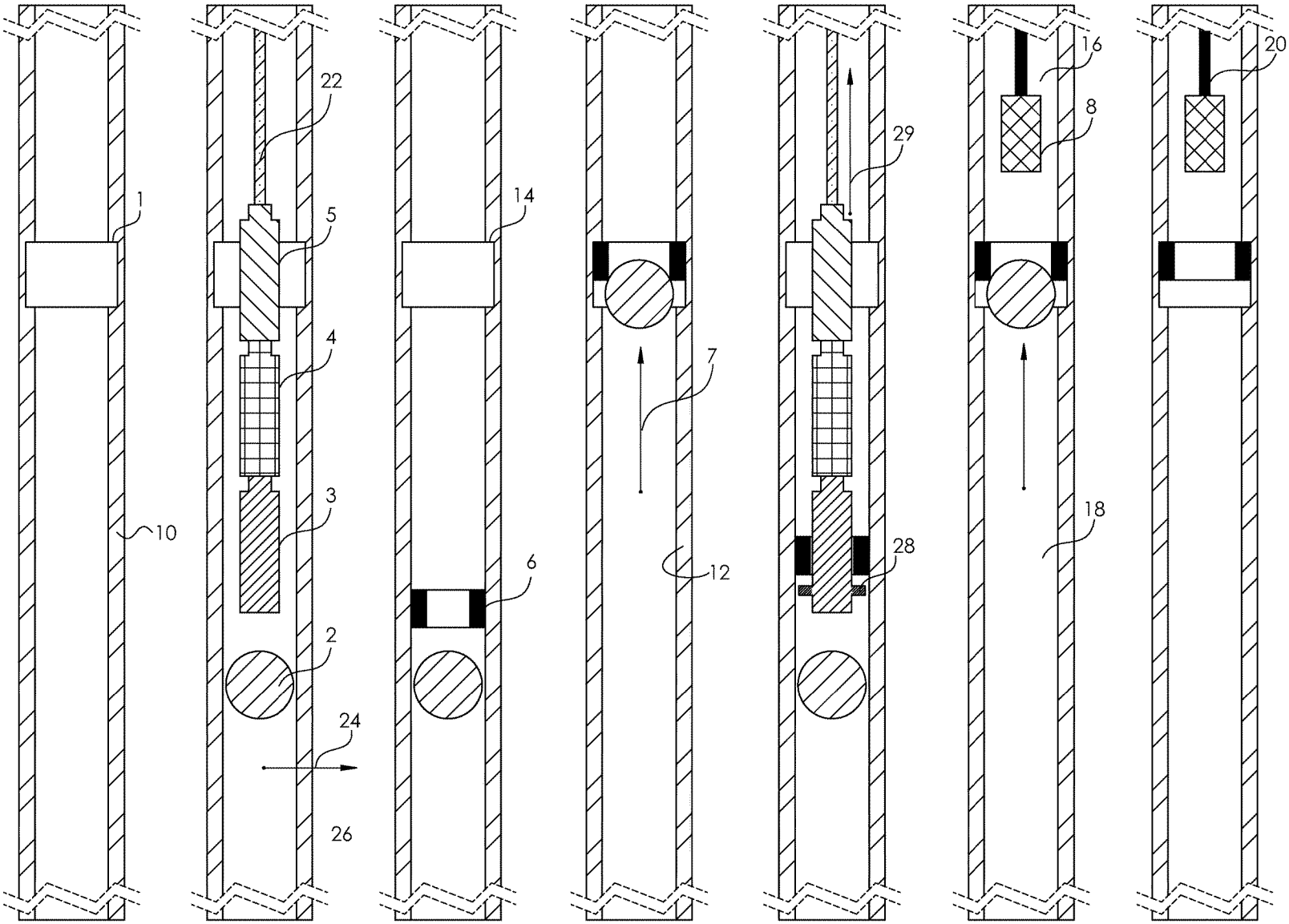
FIG. 1 is an elevation view of a portion of a tubular string showing a support location for an adaptive support.
FIG. 2 is the view of FIG. 1 showing an assembly run into just below the support location.
FIG. 3 is the view of FIG. 2 showing the adaptive support deployed against the tubular wall below the support location.
FIG. 4 is the view of FIG. 3 showing pressure from downhole translating the object that is against the adaptive support to secure the adaptive support in the support location.
FIG. 4*a* is an alternative to the view in FIG. 4 showing mechanically translating the adaptive support to the support location with an uphole force.
FIG. 5 is the view of FIG. 4 showing the ESP run in to above the adaptive support with the object pushed against the adaptive support.
FIG. 6 is the view of FIG. 5 showing the object removed so that pumping can begin.

Referring to FIG. 1, a tubular string 10 has a groove or recess 1 that can be in a short tubular sub in string 10 or integrated into a standard tool joint. Alternatively, the groove or recess can be milled into the string after the string 10 is run in the hole as described in U.S. Ser. No. 17/688,576. Ultimately, the adaptive support 6 will be moved into groove or recess 1 using formation pressure graphically represented as 7, as shown in FIG. 4. Alternatively, if borehole pressure is insufficient to move the adaptive support 6 to the groove or recess 1 the delivery tool 3 can engage the adaptive support 6 at gripper 28 and pull it into the groove or recess 1 as represented by arrow 29. Thereafter, gripper 28 releases the adaptive support 6 in its expanded state representing its second configuration. The dimensions of the groove or recess 1 can be varied. Preferably the height of the groove or recess 1 is longer than the height of the adaptive support 6 for easy entry. The depth of the groove or recess 1 is such that when the adaptive support is released to radially expand, a part of the adaptive support 6 extends into flow path 12 when shouldered against radial surface 14 of groove or recess 1. Shear loads applied from pressure below 7 as shown in FIG. 5 are resisted with upper zone 16 isolated from the already treated lower zone 18. The ESP 8 is introduced into zone 16 with pressure from zone 18 isolated. The object 2 which is preferably a sphere but can have other shapes that seal against the adaptive support 6 can be compromised after the ESP 8 is introduced so that pumping from zone 18 can start. With the object 2 compromised zones 16 and 18 are no longer separated. The ESP 8 is suspended from coiled tubing 20 and can be operated to produce the portions of the formation in zone 18 that have been previously treated prior to production. Such treatments can be fracturing, acidizing or other known formation treatment methods in common use.

As shown in FIG. 2, the bottom hole assembly comprises a wireline or electric line 22 suspending a casing collar locator 5 of a known design, followed by a setting tool 4 and a delivery tool 3 such as described in U.S. Pat. No. 11,111,747. The delivery tool 3 contains the adaptive support 6 for run in when the adaptive support 6 is in a compressed state representing its first configuration such that the adaptive support 6 stores potential energy while in a smaller radial dimension. The adaptive support 6 is pushed out of the delivery tool 3 by operation of the setting tool 4. Once that happens the potential energy is released and the adaptive support 6 is released into the flow path 12 defined by the tubular string 10. The adaptive support is preferably a coiled spring and has other features as described in U.S. Pat. Nos. 10,287,835 and 10,273,769 whose contents are incorporated by reference herein as though fully set forth.

The casing collar locator 5 senses the position of the bottomhole assembly below the groove or recess 1. The object 2 can be independently dropped into the flowpath 12 or delivered with the bottomhole assembly secured to the delivery tool 3 until released in the FIG. 2 position. Arrow 24 schematically represents the formation treatment procedures in one or more locations adjacent to the producing formation 26. These procedures could include perforation, fracturing, acidizing to name a few known procedures. The bottomhole assembly is removed after release of the adaptive support 6 and the object 2, as shown in FIG. 3. Pressure from below the object 2 represented by arrow 7 drives the object 2 against the adaptive support 6 for subsequent tandem movement until the adaptive support enters groove or recess 1 and shoulders at surface 14 and pressure in the lower zone 18 is isolated. The ESP 8 is run in when such pressure in zone 18 is isolated. Thereafter, well fluids or fluids added into tubular string 10 undermine the structural integrity, or dissolve or otherwise break up object 2 fluidly connecting zones 16 and 18 and the ESP 8 is operated to produce the formation(s) 26. Parts of the object 2 may pass through the adaptive seat 6 as zone 18 is reopened to zone 16.

Alternatively, the ESP 8 or any other tool can be run in on wireline with flow from the surface that moves the object 2 away from the adaptive support 6. Doing the procedure with wireline allows introduction of the ESP 8 or any other tool with the lower zone is in effect isolated due to the flow created by applied pressure into the upper zone 16. In that manner tools can be introduced without need for a coiled tubing unit and associated personnel and the expense of such a unit can be avoided. Once the applied pressure is removed the object 2 can be pushed back into sealing contact with the adaptive support 6 secured in groove or recess 1 using lower zone 18 pressure. The ESP 8 is landed in a receptacle and sealingly latched to that receptacle. The ESP 8 is started after the object 2 is compromised in a variety of different ways and the ESP 8 pressurizes the upper zone 16 to initiate production. The need for coiled tubing, particularly in vertical wells, for pump placement is eliminated. Horizontal wells may still require running in the ESP 8 with coiled tubing.

While the method allows a rapid reconfiguration from formation 26 treatment to isolating zone 16 from formation 26 pressure as represented by arrow 7, it also provides an economical formation isolation technique to enable operations in the isolated zone 16 such as running in an ESP. It further provides time to perform operations in zone 16 with an ability to reopen access to formation 26 to facilitate production.

While a single groove or recess 1 is shown, multiples can be used so that one can define isolated zone 18 for a pressure test to make sure that zone 18 is completely isolated. Another groove or recess 1 can be used uphole to act as a backup barrier when running in the ESP 8 or conducting another operation that needs temporary formation 26 isolation. The breakdown in one form or another of the object 2 is accomplished after a suitable time delay to run in the ESP 8 or other equipment. The removal of the object 2, that is preferably spherical, can be controlled by well fluid and material selection for the object 2 or by some form of well intervention such as adding an agent mechanism that will facilitate the removal of the object 2 by mechanical force, chemical attack or dissolution to name a few options. Other procedures in isolated zone 16 can include but are not limited to inflow testing, temporary abandonment, packer installation.

The above description is illustrative of the preferred embodiment and many modifications may be made by those skilled in the art without departing from the invention whose scope is to be determined from the literal and equivalent scope of the claims below:

We claim:

1. A method of selectively isolating downhole pressure in a downhole zone from an uphole zone in a borehole for performing an operation in the selectively isolated uphole zone, comprising:

providing a support location in a tubular string in the borehole;

running in an adaptive support in a first configuration into the tubular string;

running in an object ahead of said adaptive support, wherein said object is configured to selectively engage said adaptive support when said adaptive support is in a second configuration where said adaptive support is contacting the tubular string;

positioning said adaptive support on said support location;

driving said object against and into sealing engagement with said adaptive support using borehole pressure from below said object;

performing the operation in the uphole zone; and compromising said object.

2. The method of claim 1, comprising:

running in said object without initial contact to said adaptive support.

3. The method of claim 1, comprising:

releasing said adaptive support from said first configuration after passing said adaptive support beyond said support location.

4. The method of claim 3, comprising:

mechanically raising said adaptive support to said support location after said releasing said adaptive support from said first configuration.

5. The method of claim 1, comprising:

running in an electric submersible pump (ESP) into said uphole zone with said downhole zone pressure isolated from said uphole zone by virtue of said object and said adaptive support being in said anchored position.

6. The method of claim 5, comprising:

removing said object from sealing against said adaptive support after running in said ESP.

7. The method of claim 6, comprising:

accomplishing said removing by dissolving, degrading, chemically reacting or mechanically undermining said object;

flowing at least a portion of said object through said adaptive support due to said removing.

8. The method of claim 1, comprising:

retaining the first configuration of said adaptive support with stored potential energy;

releasing said stored potential energy to attain said second configuration of said adaptive support.

9. The method of claim 1, comprising:

using a casing collar locator to position said adaptive support, in said first configuration, beyond said support location.

10. The method of claim 1, comprising:

performing the operation in the uphole zone when said uphole zone is pressure isolated from said downhole zone.

11. The method of claim 1, comprising:

performing the operation in the uphole zone when said uphole zone is pressurized to separate said object from said adaptive support when said adaptive support is retained to said support location.

12. The method of claim 1, comprising:

accomplishing said positioning of said adaptive support with pressure from said downhole zone acting on said object when said object is in sealing contact with said adaptive support.

13. The method of claim 1, comprising:

accomplishing said positioning of said adaptive support with mechanical force.

14. The method of claim 1, comprising:

running in an electric submersible pump (ESP) into said uphole zone with uphole zone applied pressure pushing said object away from said adaptive support to enable flow toward said downhole zone with said adaptive support remaining in said anchored position.

15. A method of selectively isolating downhole pressure in a downhole zone from an uphole zone in a borehole for performing an operation in the selectively isolated uphole zone, comprising:

providing a support location in a tubular string in the borehole;

running in an adaptive support in a first configuration into the tubular string;

running in an object configured to selectively engage said adaptive support when said adaptive support is in a second configuration where said adaptive support is contacting the tubular string;

positioning said adaptive support on said support location; and using pressure in said downhole zone to drive said object toward said adaptive support when said adaptive support is in said second configuration, performing the operation in the uphole zone; and compromising said object.

16. The method of claim 15, comprising:

moving said object and said adaptive support in said second configuration in tandem in the tubular string to an anchored position with said support location.

17. The method of claim 16, comprising:

running in an electric submersible pump (ESP) into said uphole zone with said downhole zone pressure isolated from said uphole zone by virtue of said object and said adaptive support being in said anchored position.

18. The method of claim 17, comprising:

removing said object from sealing against said adaptive support after running in said ESP.

19. The method of claim 18, comprising:

accomplishing said removing by dissolving, degrading, chemically reacting or mechanically undermining said object;

flowing at least a portion of said object through said adaptive support due to said removing.

20. A method of selectively isolating downhole pressure in a downhole zone from an uphole zone in a borehole for performing an operation in the selectively isolated uphole zone, comprising:

providing a support location in a tubular string in the borehole;

running in an adaptive support in a first configuration into the tubular string;

running in an object configured to selectively engage said adaptive support when said adaptive support is in a second configuration where said adaptive support is contacting the tubular string;

positioning said adaptive support on said support location;

performing the operation in the uphole zone;

compromising said object retaining the first configuration of said adaptive support with stored potential energy;

releasing said stored potential energy to attain said second configuration of said adaptive support; and configuring the shape of said adaptive support as a rounded coiled spring.

* * * * *